US005959511A

United States Patent [19]

Pasco et al.

[11] Patent Number: 5,959,511

[45] Date of Patent: Sep. 28, 1999

[54] CERAMIC FILTER WITH RECESSED SHIELD

[75] Inventors: Wayne Pasco, Placitas; David Heine, Albuquerque, both of N.Mex.; Michael Newell, Williams Bay, Wis.

[73] Assignee: CTS Corporation, Elkhart, Ind.

[21] Appl. No.: 09/053,241

[22] Filed: Apr. 2, 1998

[51] Int. Cl.[6] ..... H01P 1/205

[52] U.S. Cl. ..... 333/206; 333/134; 333/207

[58] Field of Search ..... 333/126, 132, 333/136, 202, 206, 207, 222, 223

[56] References Cited

U.S. PATENT DOCUMENTS

| | | | |
|---|---|---|---|
| 4,431,977 | 2/1984 | Sokola et al. | 333/206 |
| 4,506,241 | 3/1985 | Makimoto et al. | 333/222 |
| 4,733,208 | 3/1988 | Ishikawa et al. | 333/202 |
| 4,742,562 | 5/1988 | Kommrusch | 333/202 X |
| 4,757,284 | 7/1988 | Ueno | 333/203 |
| 5,124,676 | 6/1992 | Ueno | 333/206 |
| 5,157,365 | 10/1992 | Hoang | 333/206 |
| 5,512,866 | 4/1996 | Vangala et al. | 333/206 X |
| 5,517,163 | 5/1996 | Sagawa et al. | 333/222 |
| 5,537,082 | 7/1996 | Tada et al. | 333/202 |
| 5,559,485 | 9/1996 | Matsuo et al. | 333/222 |
| 5,696,473 | 12/1997 | Tsujiguchi et al. | 333/202 |

FOREIGN PATENT DOCUMENTS

| | | |
|---|---|---|
| 62-104201 | 5/1987 | Japan . |
| 62-252202 | 11/1987 | Japan . |
| 1-97002 | 4/1989 | Japan . |
| 1-123501 | 5/1989 | Japan . |
| 5-226909 | 9/1993 | Japan . |

*Primary Examiner*—Seungsook Ham
*Attorney, Agent, or Firm*—Jones, Day, Reavis & Pogue

[57] ABSTRACT

A ceramic filter with recessed shield 200 is provided. Filter 200 contains a filter body with a block of dielectric material having a top surface 202, a bottom surface 204, and side surfaces 206, 208, 210 and 212 respectively. Filter 200 also has a plurality of metallized through-holes 214 extending from the top surface 202 to the bottom surface 204 defining resonators. Each of the resonators has a corresponding plurality of embedded receptacles 220, which contain an unmetallized area therein, adjacent to the plurality of metallized through-holes 214, providing a ring of isolation 222. A recessed channel 224 extends perpendicularly across each of the plurality of embedded receptacles 220 and has a groove 226 therein which is complementarily configured to receive a metallic shield 228. The metallic shield 228 is disposed in the recessed channel 224 and is connected to the metallization layer of the plurality of embedded receptacles 220. The metallic shield 228 is attached to the dielectric block with a design that reduces the size and volume of the filter 200.

35 Claims, 5 Drawing Sheets

CERAMIC FILTER WITH RECESSED SHIELD

FIELD OF THE INVENTION

This invention relates to ceramic filters, and more particularly, to a ceramic filter with a recessed shield.

BACKGROUND OF THE INVENTION

The design and use of filter circuitry for eliminating a signal of undesired frequency is well known. It is also known that these filters can be fabricated from ceramic materials having one or more resonators formed therein.

Many conventional ceramic block filters are comprised of parallelepiped shaped blocks of dielectric material through which many holes may extend from one surface to an opposite surface. Often, these filters use embedded features on the top surface in order to obtain the desired frequency characteristics of the filter.

It is well known that the top end of the resonators in a block filter have strong electric fields radiating therefrom which may adversely effect circuitry surrounding the filter in a radio or other communication device or apparatus. These radiating electric fields may also adversely effect the performance of the filter itself. In conventional filters, electric field radiation is minimized by enclosing the filter in a grounded metal housing.

Electric field radiation may also be reduced by enclosing or otherwise confining the top surface of the filter in a metal grounded bracket, which is typically soldered to the exterior sides of the block filter. Another alternative involves the use of L-Shaped stamped metal shields which are mounted to a side surface of the filter and wrap around to protect the top surfaces of the filter.

Unfortunately, the use of L-Shaped stamped metal shields presents a variety of problems during the manufacturing stage of the shielded filter and additional problems when the filter is placed onto a circuit board in communication devices. Problems include the areas of soldering, adhesion, parallelism, coplanarity, size, weight, and the number of processing steps. One significant problem for a manufacturer which uses the filter is the fact that the bottom edge of the L-Shaped stamped metal shield must be properly soldered to the circuit board to assure proper grounding of the ceramic filter. This problem is compounded by the variation in the ceramic block dimensions due to filter manufacturing process tolerances, even though the shield dimensions can be well controlled.

Another problem is encountered when low-profile components are desired. As the size of the filter block decreases, the thickness of the shield, and more significantly, the distance which the shield rests atop the filter block, becomes a greater contributor to the overall size of the filter. As the filter block size decreases, even the attachment of a metallic shield to a side surface of the block may add an undesirable "height above the circuit board" to the filter.

FIG. 1A shows a ceramic block filter with an attached external shield in accordance with the prior art. Referring to FIG. 1A, a dielectric block of ceramic 102 has a metallic shield 104 attached to the top surface thereof. It should be noted that the shield rests a predetermined distance above the ceramic block 102, adding substantial height to the filter component.

FIG. 1B and FIG. 1C show two different techniques for attaching the external shields 104 to the block of dielectric ceramic 102 and the circuit board 106 in accordance with the prior art. In FIG. 1B, the metallic shield 104 is attached directly to the block of dielectric ceramic 102 whereas in FIG. 1C, the metallic shield 104 is attached to both the block of dielectric ceramic 102 as well as to the circuit board 106. In both instances, the metallic shield 104 adds substantial size and volume to the overall filter component dimensions.

It would be considered an improvement in the art to provide a ceramic filter with a recessed shield design which is entirely self-contained and can be attached directly to the conductive metallization layer on the top surface of the filter, while also providing the advantages of a smaller-sized, rugged, compact filter component which is particularly well suited for large scale and automated manufacturing processes and operations and which provides for easier fixturing, assembly, and testing.

DETAILED DESCRIPTION OF THE PREFERRED EMBODIMENT

Figure 1A:
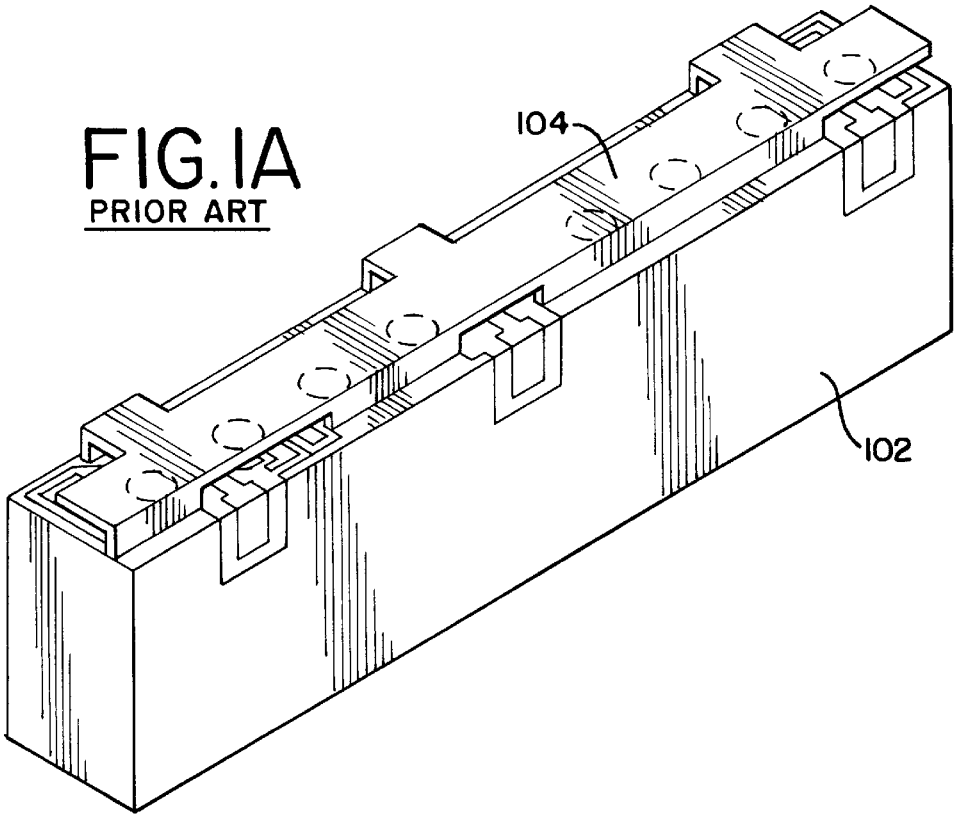
FIG. 1A PRIOR ART
FIG. 1A shows a ceramic block filter with an attached external shield in accordance with the prior art.
Figure 1B:
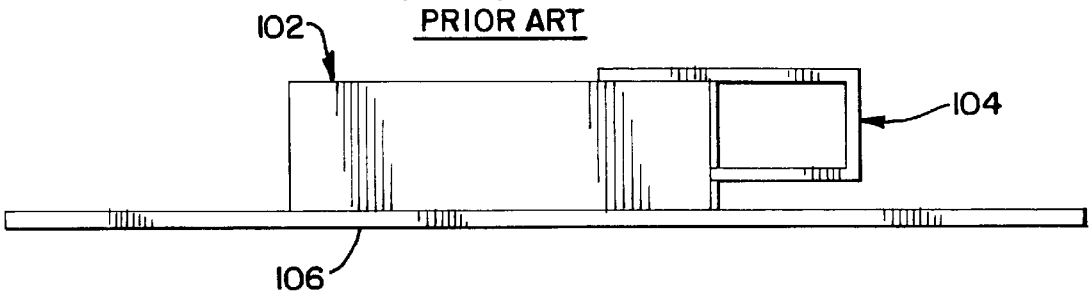
FIG. 1B PRIOR ART
FIG. 1B shows a side view of a ceramic block filter with an attached external shield in accordance with the prior art.
Figure 1C:
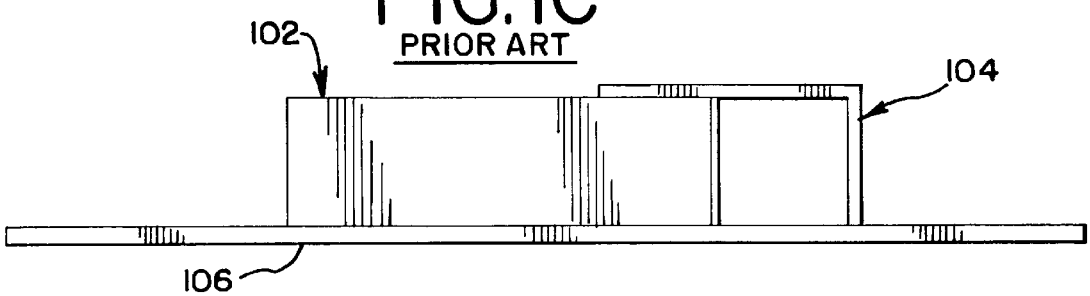
FIG. 1C PRIOR ART
FIG. 1C shows a side view of another embodiment of a ceramic block filter with an attached external shield in accordance with the prior art.
Figure 2A:
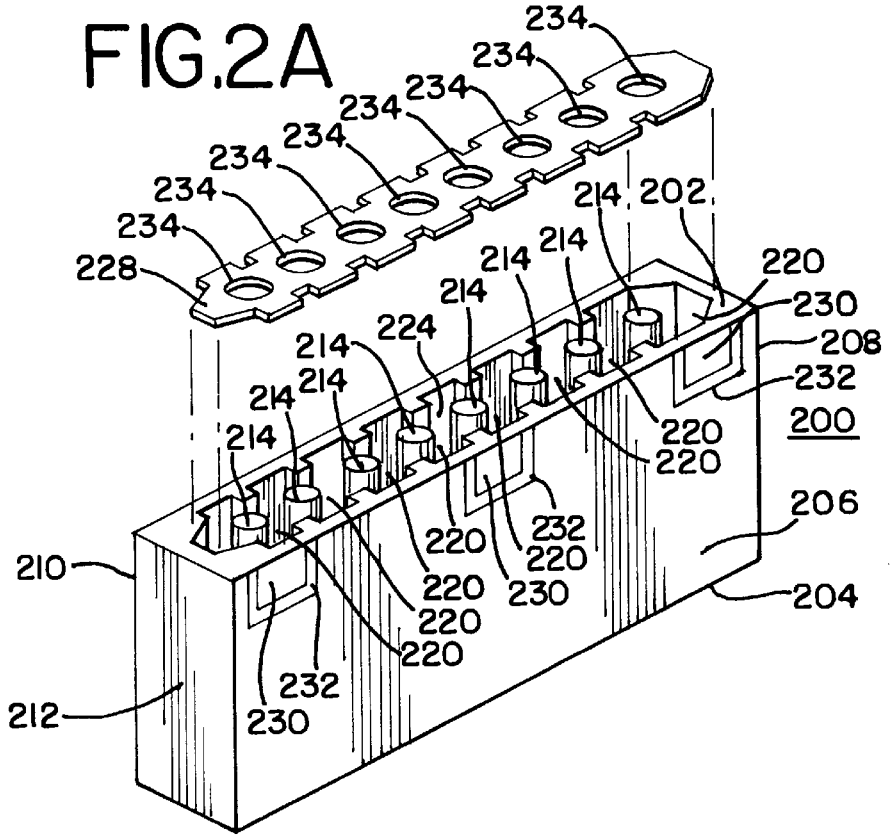
FIG. 2A shows a ceramic filter with a recessed shield in accordance with one embodiment of the present invention.
Figure 2B:
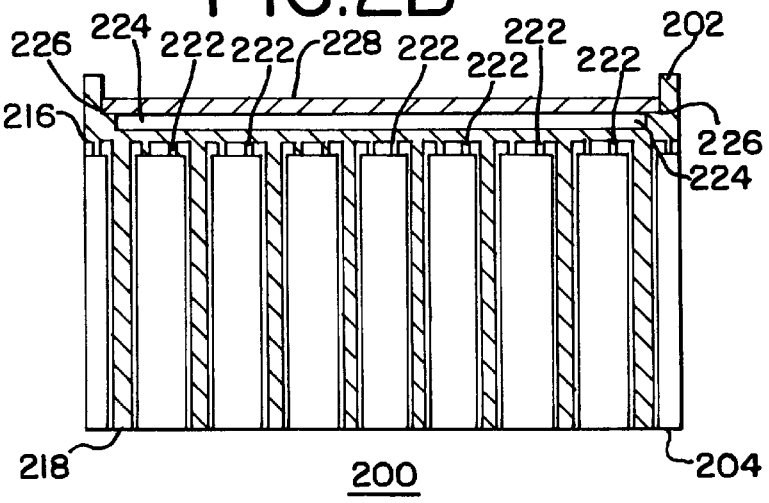
FIG. 2B shows a cross-sectional view of the ceramic filter with a recessed shield of FIG. 2A in accordance with one embodiment of the present invention.
Figure 2C:
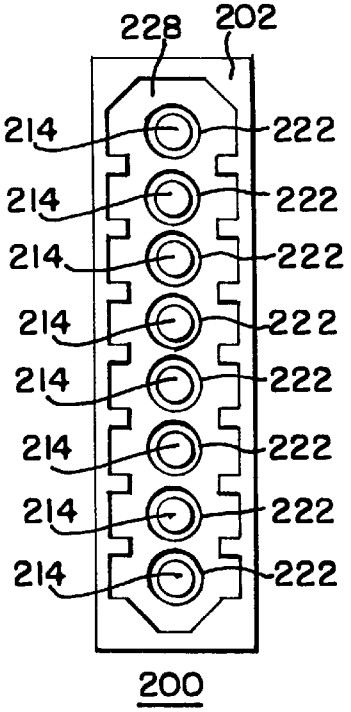
FIG. 2C shows a top view of the ceramic filter with a recessed shield of FIG. 2A in accordance with one embodiment of the present invention.

FIG. 2A shows a perspective view of a ceramic filter with a recessed shield in accordance with one embodiment of the present invention. FIG. 2B shows a cross-sectional view of the ceramic filter with a recessed shield of FIG. 2A and FIG. 2C shows a top view of the ceramic filter with a recessed shield of FIG. 2A.

Referring to FIG. 2A, a ceramic filter with recessed shield 200 is provided. Filter 200 contains a filter body with a block of dielectric material having a top surface 202, a bottom surface 204, and side surfaces 206, 208, 210 and 212 respectively. Filter 200 also has a plurality of metallized through-holes 214 extending from the top surface 202 to the bottom surface 204 defining resonators.

Each resonator has an open circuited end 216 (see FIG. 2B) and each resonator has a short circuited end 218 (see FIG. 2B). Each of the resonators has a corresponding plurality of embedded receptacles 220 adjacent to the top surface 202 of the filter 200. A conductive material defining a metallization layer substantially covers the top surface 202, the bottom surface 204 and the side surfaces 206, 208, 210 and 212 of filter 200 as well as the plurality of metallized through-holes 214 and the plurality of embedded receptacles 220.

However, each of the plurality of embedded receptacles 220 also contains an unmetallized area therein, adjacent to the plurality of metallized through-holes 214, providing a ring of isolation 222 which defines the open circuited end 216 of the resonators.

A recessed channel 224 extends perpendicularly across each of the plurality of embedded receptacles 220 as shown in FIGS. 2A and 2B. The recessed channel 224 has a groove 226 therein which is complementarily configured to receive a metallic shield 228. The metallic shield 228 is disposed in the recessed channel 224 and the metallic shield 228 is connected to the metallization layer of the plurality of embedded receptacles 220.

The metallic shield 228 is electrically isolated from the resonators by the rings of isolation 222 and the metallic shield is positioned in the groove 226 above and thereby physically isolated from the rings of isolation 222. Metallic shield 228 is notched in FIG. 2A, such that it fits snugly and is recessed in the block of dielectric material. In other embodiments, the shield may not be notched. Moreover, the shield in FIG. 2A has tuning windows 234 aligned substantially directly above the through-holes 214.

Filter 200 also contains at least first and second input-output pads 230 comprising an area of conductive material on at least one of the side surfaces 206, 208, 210 and 212 of filter 200 and at least immediately surrounded by an unmetallized area 232.

The advantages of a ceramic filter with a recessed shield are numerous. Foremost is the size reduction As the shield is placed flush against the top surface of the block, or even recessed down inside the block itself, vast size reductions may be realized. This is important as the electronic signal processing devices such as cellular telephones, pagers, and the like are ever decreasing in size, weight, and volume.

Another advantage of the ceramic filter with a recessed shield design involves ease of alignment. Whereas previous filters contained a bulky, heavy, cumbersome shield attached to the outer surfaces of the dielectric filter, the instant design allows a thin sheet of metal to be punched into a custom shape and easily inserted down into a groove on the top surface of the filter block. Between the precise ceramic filter pressing tolerances and the precise sheet metal punching tolerances, a snug and tight fit may be achieved as the shield rests in the recess. Moreover, as the receptacles which form the groove may be metallized (coated with a conductive coating) prior to shield attachment, the shield may then be attached to the metallization on the top surface of the filter block using a conductive epoxy, solder, or any other adhesive means.

An improved solder design is still another advantage of the instant invention. With previous shield attachment designs, the overhanging shield was not easily attached to filter on the side surface of the block of dielectric ceramic. In fact, oftentimes when the solder material reached its melting temperature, the shield would move resulting in mis-alignment and other manufacturing problems. With the present recessed shield design, the soldering operation becomes easier to perform rapidly and efficiently. Since the shield already fits snugly in the recess on the top of the filter, it does not move when the solder reaches its melting temperature. Moreover, for certain embodiments of the present invention, the recessed groove forms a lip around the through-holes which creates a ledge which is an ideal location for a solder attachment.

Another advantage of the recessed shield design is that coplanarity, a very difficult shield property to control, becomes less of an issue. With the overhanging shield design of previous filters, attachment to a circuit board oftentimes proved difficult. A shield that was not coplanar with the filter may not properly attach to the circuit board or may cause other grounding problems. With the recessed shield design, the groove in which the shield rests may or may not be much deeper than the actual thickness of the shield itself.

As such, in the event where the shield is not exactly coplanar, it will still be nestled down in the groove, below the top surface of the filter block. Equally important, if the shield becomes bowed or if the metallization or solder layer is uneven, the shield will remain recessed and can still perform its function of preventing stray signals from passing between the resonators. This feature allows a greater degree of tolerance during manufacturing operations resulting in increased throughput and efficiencies.

The present invention also allows properly sized metallic shields to be employed. With previous filter designs, to compensate for the added volume and bulkiness that the metallic shield provided, designers attempted to minimize this effect by using thinner and thinner shields. This often resulted in shields that were too flexible and created other problems. With the present design, a shield which has the proper rigidity and thickness may be used, and no extra space is required because the shield is recessed directly into the block of dielectric ceramic.

With the present design, a relatively thin shield may effectively eliminate stray signals between the resonators. For example, the metallic shield may be made of a tin plated material and has a thickness about 0.005 inches. With a recessed shield design, the dielectric block itself provides sufficient support such that the shield may be very thin. However, one challenge with fitting a metallic shield into a recess in a block of dielectric involves the coefficients of thermal expansion (CTE) for the respective materials. Certainly the metallic materials which may be used for the shield are known to have a greater CTE than the dielectric ceramic compositions used with the filter blocks. As such, care must be taken during the design process to avoid stresses in the recess of the dielectric block during any subsequent reflow operations after shield attachment.

The shields of the present invention are custom designed and may include tuning windows through which the dielectric block may be tuned. Although the tuning windows could be rendered unnecessary if the shield were attached after the filters had been already tuned, from a practical manufacturing point of view, the shield should be attached in an earlier processing step. This is because the addition of the shield may effect the filter characteristics. As such, in a preferred embodiment of the present invention, the shield will be punched or manufactured to include tuning windows therein. The tuning windows may be aligned directly over each through-hole and may have any of a variety of shapes. In preferred embodiments, the tuning windows will be substantially circular or oval or square or rectangular in shape.

The important parameters for the tuning windows are as follows: the tuning window of the metallic shield should be sufficiently small so as to prevent unwanted coupling between the resonators. This is the purpose for which the shield is attached in the first place. Also, the tuning windows should be sufficiently large so as to accept a laser beam, abrasive rotary tool, or other metallization removal medium therethrough.

The ring of isolation is another important aspect of the present invention. In previous filter designs, the metallic shields were purposefully positioned away from the metallization layer on the block of dielectric material so as not to interfere or cause a short in on the filter surface. The present invention proposes to attach the metallic shield directly to the metallization on the surface of the filter. As such, it is a function of the ring of isolation to effectively separate the resonators from the metallization of the receptacles and ultimately from conducting to the metallic shield itself. To achieve the proper isolation, one embodiment strategically and purposefully places a groove in a recessed channel to elevate the shield above the ring of isolation. In the flush mounted metallic shield design, the top surface of the dielectric filter block effectively isolates the metallic shield from the ring of isolation.

The ring of isolation also effectively defines the open circuited end of the resonators themselves. Therefore, the strategic placement of the ring of isolation defines the physical and electrical length of the resonator as well as the inter-resonator coupling. These are important design criteria and may be varied for different filter applications. Moreover, the width, radius, and diameter of the ring of isolation may also be varied for different filter designs, so long as the resonators are effectively isolated from the embedded receptacles and the metallic shield or shields.

The recessed features, namely the embedded receptacles and the recessed channel also are an important aspect of the present invention. In a preferred embodiment, these recessed features will be formed in the mold at the time the dielectric blocks are pressed, although these features could be carved into the dielectric block at a later stage of the filter manufacturing operation. Those skilled in the art will understand that the embedded receptacles are not part of the resonators due to the isolation provided by the ring of isolation.

Additionally, the plurality of embedded receptacles may have a variety of different shapes and designs. For example, in one embodiment, the embedded receptacles may be substantially funnel-shaped (see dashed lines in FIG. 4B discussed below). Other embodiments may have various tapers or lips or ledges depending upon the needs of the specific design. One should note that for different funnel-shaped receptacle designs, the ring of isolation may be placed at any predetermined location on the funnel. Of course, if the receptacle is funnel-shaped and the ring of isolation is deeper inside the embedded receptacle, it will necessarily have a smaller diameter.

One preferred receptacle design involves a substantially circular receptacle of larger diameter and a substantially circular through-hole of smaller diameter. Such a design is particularly well suited for manufacturing because the ring of isolation may then be strategically placed on the ledge between the two holes of dissimilar diameters. Such a ledge would be substantially flat and substantially parallel to the top surface of the dielectric block. Thus, the ring of isolation could be easily formed using a laser or other metallization removal technology through the tuning windows.

A variation of the present invention may involve the introduction of a flush-mounted shield. Whereas a flush-mounted shield may add greater volume and size to the filter component than the recessed-mounted shield, it nevertheless also provides a substantial reduction in size and volume relative to the attached shields of the prior art.

Figure 3A:
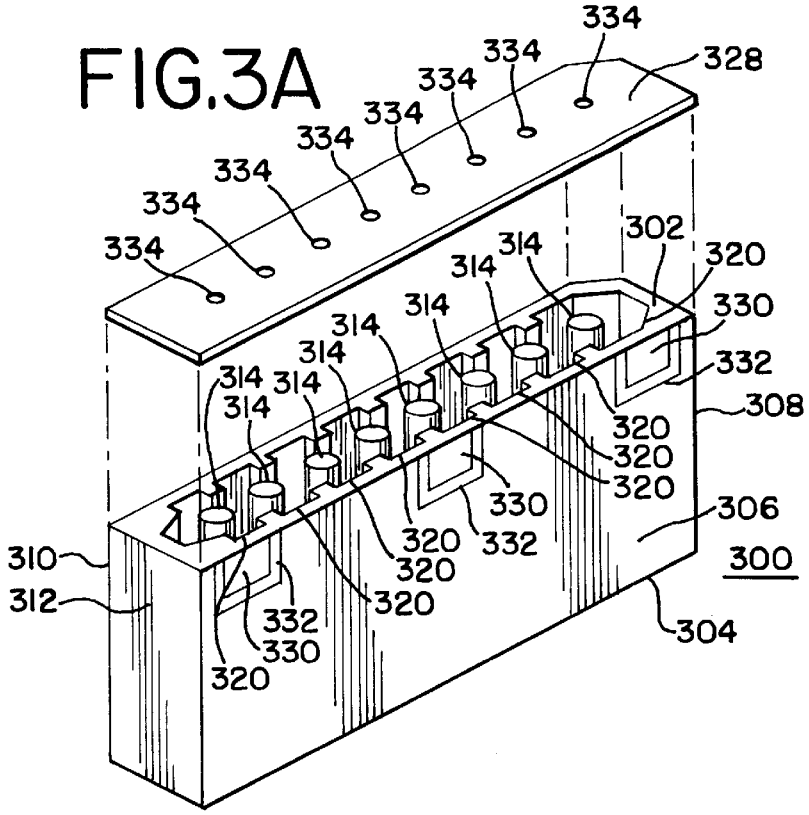
FIG. 3A shows a ceramic filter with a flush mounted metallic shield in accordance with another embodiment of the present invention.
Figure 3B:
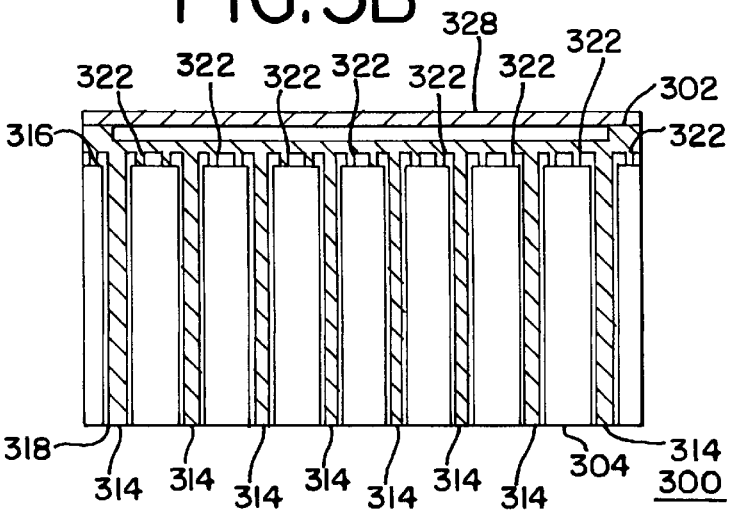
FIG. 3B shows a cross-sectional view of the ceramic filter with a flush mounted metallic shield of FIG. 3A in accordance with another embodiment of the present invention.
Figure 3C:
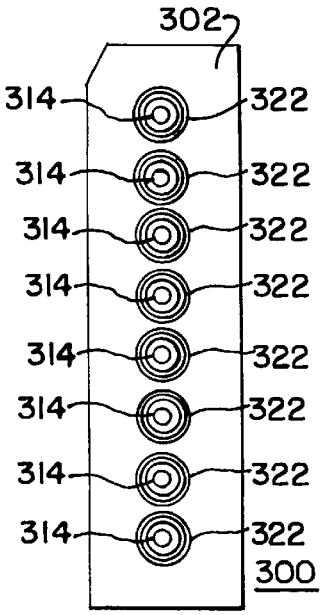
FIG. 3C shows a top view of the ceramic filter with a flush mounted metallic shield of FIG. 3A in Accordance with one embodiment of the present invention.

FIG. 3A shows a perspective view of a ceramic filter with a flush-mounted shield in accordance with one embodiment of the present invention. FIG. 3B shows a cross-sectional view of the ceramic filter with a flush-mounted shield of FIG. 3A and FIG. 3C shows a top view of the ceramic filter with a flush-mounted shield of FIG. 3A.

Referring to FIG. 3A, a ceramic filter with a flush-mounted shield 300 is provided. Filter 300 contains a filter body with a block of dielectric material having a top surface 302, a bottom surface 304, and side surfaces 306, 308, 310 and 312 respectively. Filter 300 also has a plurality of metallized through-holes 314 extending from the top surface 302 to the bottom surface 304 defining resonators.

Each resonator has an open circuited end 316 (see FIG. 3B) and each resonator has a short circuited end 318 (see FIG. 3B). Each of the resonators has a corresponding plurality of embedded receptacles 320 adjacent to the top surface 302 of the filter 300. A conductive material defining a metallization layer substantially covers the top surface 302, the bottom surface 304 and the side surfaces 306, 308, 310 and 312 of filter 300 as well as the plurality of metallized through-holes 314 and the plurality of embedded receptacles 320.

However, each of the plurality of embedded receptacles 320 contains an unmetallized area therein, adjacent to the plurality of metallized through-holes 314, providing a ring of isolation 322 which defines the open circuited end 316 of the resonators.

In FIGS. 3A–3C, a metallic shield 328 is flush-mounted to the metallization layer on the top surface 302 of the filter 300. The metallic shield 328 is isolated from the resonators by the rings of isolation 322. Metallic shield 328 has dimensions that are substantially the same as the length and width of the filter 300, such that the shield attaches uniformly to the top surface 302 thereof. Moreover, the shield in FIG. 3A has circular tuning windows 334 aligned substantially directly above the through-holes 314.

Filter 300 also contains at least first and second input-output pads 330 comprising an area of conductive material on at least one of the side surfaces 306, 308, 310 and 312 of filter 300 and at least immediately surrounded by an unmetallized area 332. Filter 300 provides a metallic shield 328 which can be easily flush-mounted to the top surface 302 of a filter 300.

Sill another variation of the present invention may involve the introduction of plug-mounted shields. This type of shielding may be particularly well suited for automation and is described in FIGS. 4A–4C. With a plug-mounted shield design, each individual through-hole on the filter block is plugged with its own respective metallic shield. Thus, a set of "mini-shields" are able to provide effective shielding for the filter and prevent stray signals from passing between the resonators. In another embodiment, these "mini-shields" may be flush mounted to the top surface of the dielectric block of ceramic.

Figure 4A:
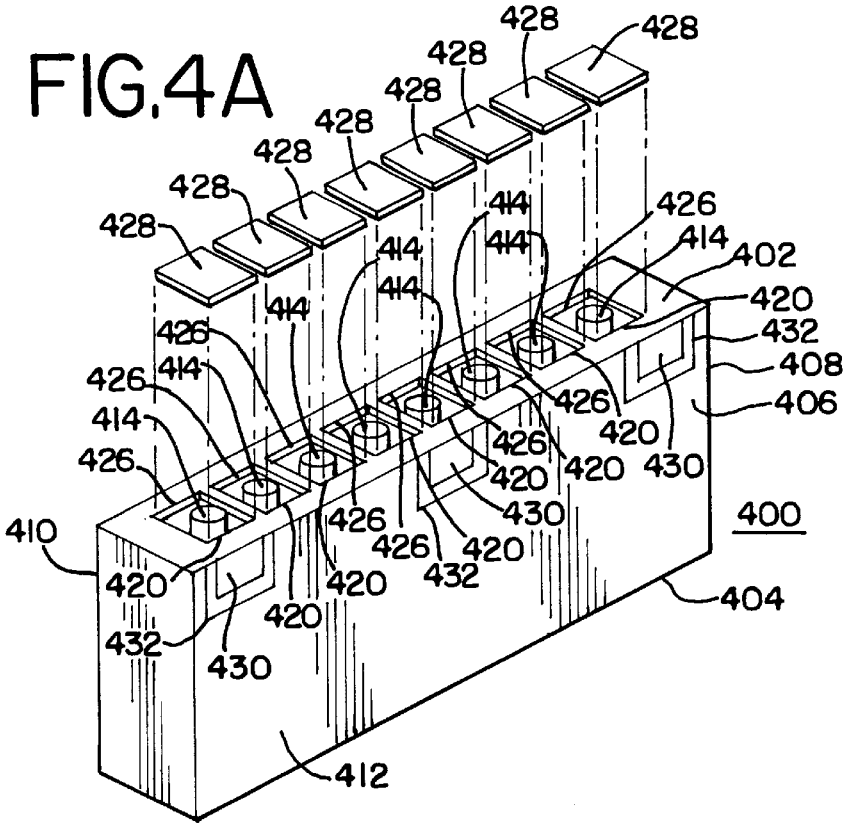
FIG. 4A shows a ceramic filter with plug mounted metallic shields in accordance with another embodiment of the present invention.
Figure 4B:
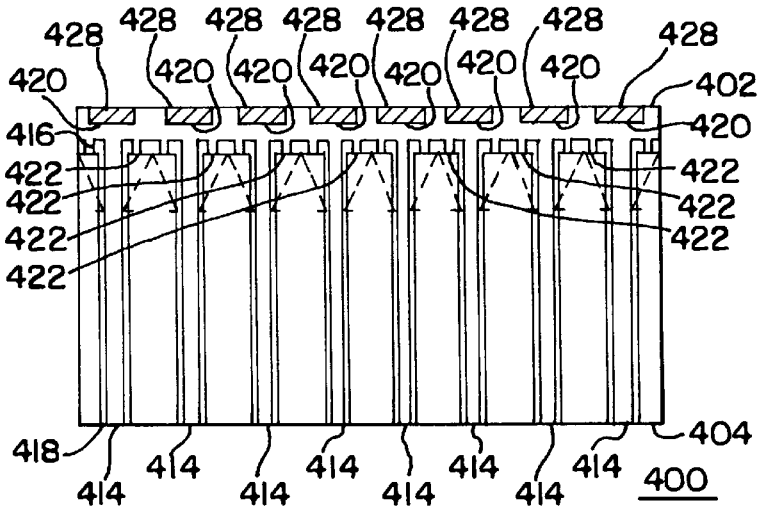
FIG. 4B shows a cross-sectional view of the ceramic filter with plug mounted metallic shields of FIG. 4A in accordance with one embodiment of the present invention.
Figure 4C:
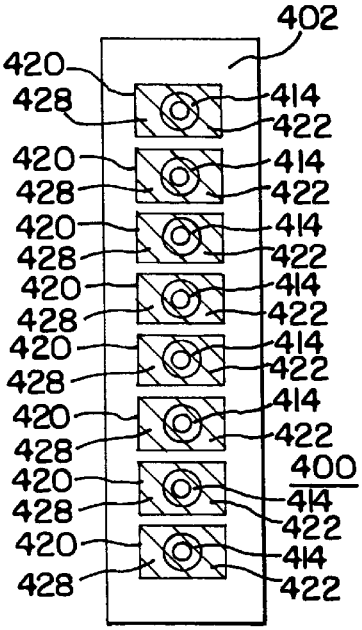
FIG. 4C shows a top view of the ceramic filter with plug mounted metallic shields of FIG. 4C in accordance with one embodiment of the present invention.

FIG. 4A shows a perspective view of a ceramic filter with a plurality of plug-mounted type shields in accordance with one embodiment of the present invention. FIG. 4B shows a cross-sectional view of the ceramic filter of FIG. 4A and FIG. 4C shows a top view of the ceramic filter of FIG. 4A.

Referring to FIG. 4A, a ceramic filter with plug-mounted metallic shields 400 is provided. Filter 400 contains a filter body with a block of dielectric material having a top surface 402, a bottom surface 404, and side surfaces 406, 408, 410 and 412 respectively. Filter 400 also has a plurality of metallized through-holes 414 extending from the top surface 402 to the bottom surface 404 defining resonators.

Each resonator has an open circuited end 416 (see FIG. 4B) and each resonator has a short circuited end 418 (see FIG. 4B). Each of the resonators has a corresponding plurality of embedded receptacles 420 adjacent to the top surface 402 of the filter 400. A conductive material defining a metallization layer substantially covers the top surface 402, the bottom surface 404 and the side surfaces 406, 408, 410 and 412 of filter 400 as well as the plurality of metallized through-holes 414 and the plurality of embedded receptacles 420.

However, each of the plurality of embedded receptacles 420 contains an unmetallized area therein, adjacent to the plurality of metallized through-holes 414, providing a ring of isolation 422 which defines the open circuited end 416 of the resonators.

Referring to FIG. 4A, each of the plurality of embedded receptacles 420 has a groove 426 therein which is complementarily configured to receive a plurality of metallic shields 428. The metallic shields 428 are disposed in the embedded receptacles 420 and the plurality of metallic shields 428 are connected to the metallization layer of the plurality of embedded receptacles 420.

Significantly, the metallic shields 428 are isolated from the resonators by the rings of isolation 422 and the metallic shield is positioned in the groove 426 above and isolated from the rings of isolation 422.

Filter 400 also contains at least first and second input-output pads 430 comprising an area of conductive material on at least one of the side surfaces 406, 408, 410 and 412 of filter 400 and at least immediately surrounded by an unmetallized area 432.

From a manufacturing perspective, the ceramic filter with a recessed shield design leads to greater automation and technology-aided manufacturing operations. The recessed shield design is highly adaptable for incorporation with lasers, robotics, and other mechanisms that reduce cost, labor and time.

The present invention contemplates a method of manufacturing a ceramic filter with a recessed shield comprising the steps of first pressing a block of dielectric having through-holes and embedded coupling receptacles and a recessed channel having a groove disposed therein. This may be accomplished using presently available material processing and pressing capabilities. Next, a step of applying a metallization coating over the block of dielectric may be performed. This could also be accomplished using conventional coating technologies including but not limited to screen printing, brushing, immersion, roll coating, spraying or other deposition techniques.

The next step to manufacture a ceramic filter with a recessed shield may involve attaching a metallic shield having tuning windows to the dielectric block in the recessed channel. This may be performed using a variety of adhesion technologies, although in a preferred embodiment, the metallic shield would be soldered to the metallization layer on the groove in the recessed channel in the dielectric block of ceramic.

One area which is particularly well suited for automation involves the next step of the operation, namely removing metallization in the embedded receptacles to provide a ring of isolation. The ring of isolation is an important aspect of the present invention because it is the ring which allows the through-holes of the dielectric block to be formed into resonators. More specifically, the ring of isolation defines the open circuited end of the resonators. Stated another way, everything below the ring of isolation to the bottom surface of the dielectric block is part of the resonator. As such, a complete electrical open must be created between the receptacles and the resonators.

To perform this operation, the inventors contemplate that this may be readily achieved using a laser applied through the tuning window of the metallic shield. A laser has the necessary power to remove metallization and also has the precision ability to be focused through a tuning window in the metallic shield and also can produce clean, reproducible rings of isolation in the receptacles, near each resonator through-hole. Thus, in a preferred embodiment, the rings of isolation would be formed using laser processing techniques. Other methods of selective metallization removal may include bead blasting, abrasive rotary tool, print patterning, or etching.

A final step in the manufacturing operation may involve tuning the ceramic filter to a desired frequency by further removing metallization from the embedded receptacles. This may also preferably be accomplished using a laser applied through the tuning window of the metallic shield. Of course, this step could also be achieved using one of the many other techniques discussed above.

One reason that this process is easily automated involves the fact that the tuning operation, achieved through precision placement of a laser through the tuning windows in the shield, is easily repeatable. The inventors postulate that successive filter blocks could be rapidly tuned with great repeatability. Moreover, it may be necessary to return to certain resonators in a single dielectric block to achieve a desired frequency response. An automated system, which required precision laser metallization removal and which employed a means for monitoring filter characteristics as a function of metallization removal and which allowed for great repeatability and high throughput is within the scope of the present invention.

Figure 5:
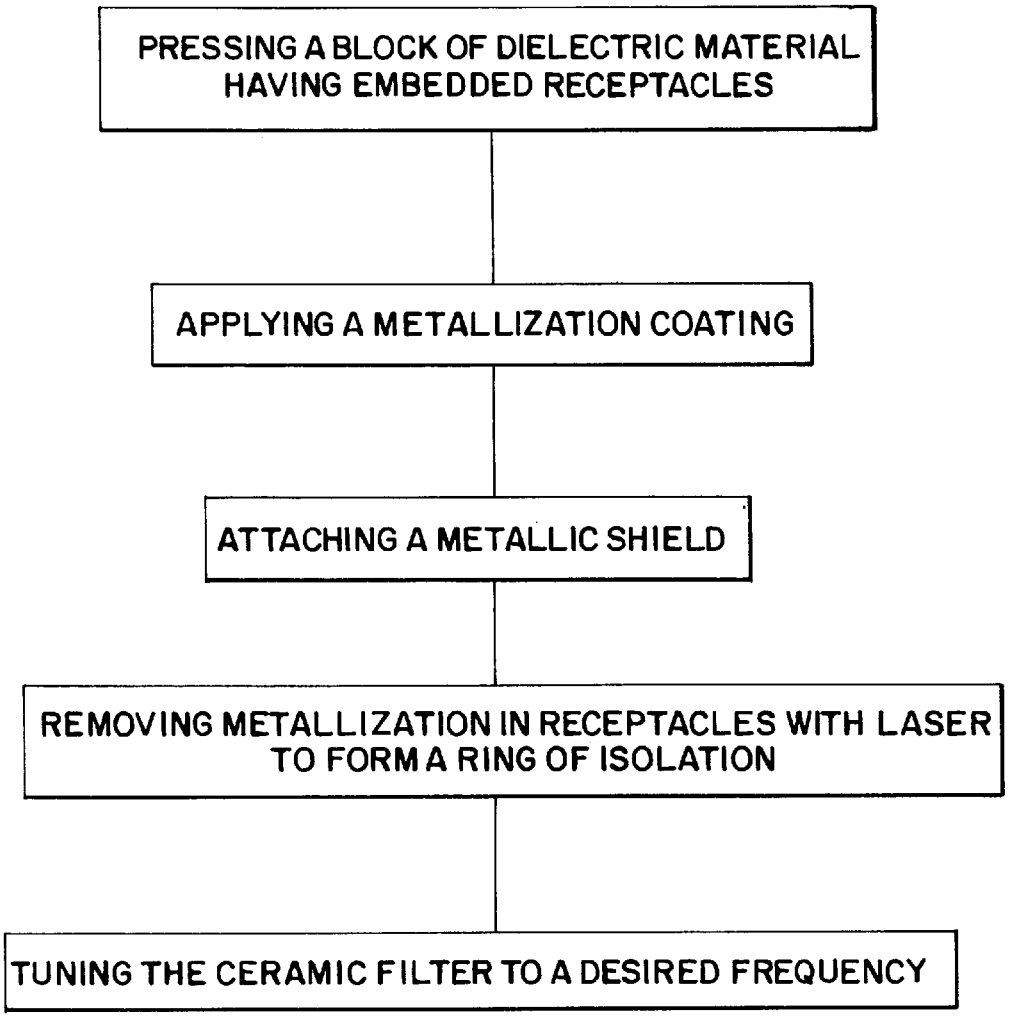
FIG. 5 shows a flow diagram of the steps involved in the manufacture of a ceramic filter with a recessed shield in accordance with the present invention.

A summary of the steps involved in the manufacture of a ceramic block filter with this novel shielding design is provided in FIG. 5. which shows a flow diagram of the significant processing steps. Referring to FIG. 5, a block of dielectric material must be pressed to have embedded receptacles. Next, a metallization coating may be applied to all external surfaces including through-holes and receptacles. The metallic shield may then be attached. A subsequent step involves removing metallization from the receptacles to form a ring of isolation. Finally the metallized block of dielectric may be tuned to a desired frequency.

Although various embodiments of this invention have been shown and described, it should be understood that various modifications and substitutions, as well as rearrangements and combinations of the preceding embodiments, can be made by those skilled in the art, without departing from the novel spirit and scope of this invention.

What is claimed is:

1. A ceramic filter with recessed shield, comprising:

a filter body comprising a block of dielectric material and having top, bottom, and side surfaces, and having a plurality of metallized through-holes extending from the top surface to the bottom surface defining resonators having an open circuited end and a short circuited end and having a corresponding plurality of embedded receptacles adjacent to the top surface thereof;

a conductive material defining a metallization layer substantially covering the top, bottom and side surfaces as well as the plurality of metallized through-holes and the plurality of embedded receptacles with the exception that each of the plurality of embedded receptacles contains an unmetallized area therein adjacent to the plurality of metallized through-holes providing a ring of isolation which defines the open circuited end of the resonators;

a recessed channel extending perpendicularly across each of the plurality of embedded receptacles, the recessed channel having a groove therein are complementarily configured to receive a metallic shield;

a metallic shield disposed in the recessed channel, the metallic shield connected to the metallization layer of the plurality of embedded receptacles, the metallic shield is isolated from the resonators by the ring of isolation and the metallic shield is positioned in the groove above and isolated from the ring of isolation; and at least first and second input-output pads comprising an area of conductive material on at least one of the side surfaces and at least immediately surrounded by an unmetallized area.

2. The ceramic filter of claim 1, wherein the metallic shield further comprises a plurality of tuning windows vertically aligned above the resonators.

3. The ceramic filter of claim 1, wherein the plurality of embedded receptacles are substantially funnel-shaped.

4. The ceramic filter of claim 1, wherein the plurality of embedded receptacles are substantially circular having a diameter which is substantially greater than a through-hole diameter.

5. The ceramic filter of claim 1, wherein the metallic shield is attached to the metallization layer by a soldering technique.

6. The ceramic filter of claim 1, wherein the ring of isolation is provided by a laser metallization removal technique.

7. The ceramic filter of claim 1, wherein the ring of isolation is provided by a screen printing technique.

8. The ceramic filter of claim 1, wherein the ring of isolation is provided by an abrasive blast technique.

9. The ceramic filter of claim 1, wherein the metallic shield comprises a tin plated material and has a thickness of about 0.005 inches.

10. The ceramic filter of claim 1, wherein the metallic shield substantially minimizes unwanted coupling between the resonators.

11. A ceramic filter with flush mounted shield, comprising:

a filter body comprising a block of dielectric material and having top, bottom, and side surfaces, and having a plurality of metallized through-holes extending from the top surface to the bottom surface defining resonators having an open circuited end and a short circuited end and having a corresponding plurality of embedded receptacles adjacent to the top surface thereof;

a conductive material defining a metallization layer substantially covering the top, bottom and side surfaces as well as the plurality of metallized through-holes and the plurality of embedded receptacles with the exception that each of the plurality of embedded receptacles contains an unmetallized area therein adjacent to the plurality of metallized through-holes providing a ring of isolation which defines the open circuited end of the resonators;

a flush mounted metallic shield disposed on the top surface of the block of dielectric material extending perpendicularly across each of the plurality of embedded receptacles, the metallic shield connected to the metallization layer on the top surface of the block of dielectric material and isolated from the resonators by the ring of isolation; and at least first and second input-output pads comprising an area of conductive material on at least one of the side surfaces and at least immediately surrounded by an unmetallized area.

12. The ceramic filter of claim 11, wherein the flush mounted metallic shield is attached to the block of dielectric with an epoxy conductive material.

13. The ceramic filter of claim 11, wherein the flush mounted metallic shield further comprises a plurality of tuning windows vertically aligned above the resonators.

14. The ceramic filter of claim 11, wherein the plurality of embedded receptacles are substantially funnel-shaped.

15. The ceramic filter of claim 11, wherein the plurality of embedded receptacles are substantially circular having a diameter which is substantially greater than a through-hole diameter.

16. The ceramic filter of claim 11, wherein the flush mounted metallic shield is attached to the metallization layer on the top surface of the block of dielectric by a soldering technique.

17. The ceramic filter of claim 11, wherein the ring of isolation is provided by a laser metallization removal technique.

18. The ceramic filter of claim 11, wherein the ring of isolation is provided by a screen printing technique.

19. The ceramic filter of claim 11, wherein the ring of isolation is provided by an abrasive blast technique.

20. The ceramic filter of claim 11, wherein the flush mounted metallic shield substantially minimizes unwanted coupling between the resonators.

21. A ceramic filter, comprising:

a filter body comprising a block of dielectric material and having top, bottom, and side surfaces, and having a plurality of metallized through-holes extending from the top surface to the bottom surface defining resonators having an open circuited end and a short circuited end and having a corresponding plurality of embedded receptacles adjacent to the top surface thereof;

a conductive material defining a metallization layer substantially covering the top, bottom and side surfaces as well as the plurality of metallized through-holes and the plurality of embedded receptacles with the exception that each of the plurality of embedded receptacles contains an unmetallized area therein adjacent to the plurality of metallized through-holes providing a ring of isolation which defines the open circuited end of the resonators;

each of the plurality of embedded receptacles having a groove therein complementarily configured to receive a metallic shield;

a plurality of metallic shields disposed in the respective plurality of embedded receptacles, the plurality of metallic shields connected to the metallization layer of the plurality of embedded receptacles, the plurality of metallic shields are isolated from the resonators by the ring of isolation and the plurality of metallic shields are positioned in the groove above and isolated from the ring of isolation; and at least first and second input-output pads comprising an area of conductive material on at least one of the side surfaces and at least immediately surrounded by an unmetallized area.

22. The ceramic filter of claim 21, wherein the plurality of metallic shields each comprise a tuning window vertically aligned above each of the respective resonators.

23. The ceramic filter of claim 21, wherein the plurality of embedded coupling receptacles are substantially funnel-shaped.

24. The ceramic filter of claim 21, wherein the plurality of embedded coupling receptacles are substantially circular having a diameter which is substantially greater than a through-hole diameter.

25. The ceramic filter of claim 21, wherein the plurality of metallic shields are attached to the metallization layer of the respective embedded coupling receptacles by a soldering technique.

26. The ceramic filter of claim 21, wherein the ring of isolation is provided by a laser metallization removal technique.

27. The ceramic filter of claim 21, wherein the ring of isolation is provided by a screen printing technique.

28. The ceramic filter of claim 21, wherein the ring of isolation is provided by an abrasive blast technique.

29. The ceramic filter of claim 21, wherein the metallic shield comprises a tin plated material and has a thickness of about 0.005 inches.

30. The ceramic filter of claim 21, wherein the plurality of metallic shields substantially minimize unwanted coupling between the respective resonators.

31. A method of manufacturing a ceramic filter with a recessed shield comprising the steps of:

pressing a block of dielectric having through-holes and embedded receptacles and a recessed channel having a groove disposed therein;

applying a metallization coating over the block of dielectric;

attaching a metallic shield having tuning windows to the groove in the recessed channel of the dielectric block;

removing metallization in the embedded receptacles to provide a ring of isolation using a laser applied through the tuning window of the metallic shield; and tuning the ceramic filter to a desired frequency by further removing metallization from the embedded receptacles using a laser applied through the tuning window of the metallic shield.

32. The method of claim 31, wherein the plurality of embedded receptacles are substantially circular having a diameter which is substantially greater than a through-hole diameter.

33. The method of claim 31, wherein the groove in the recessed channel is complimentarily configured to receive the metallic shield.

34. The method of claim 31, wherein the metallic shield is attached to the dielectric block with a solder material.

35. The method of claim 31, wherein the tuning window of the metallic shield is sufficiently small as to prevent capacitive coupling between the resonators and sufficiently large to accept a laser beam therethrough.

* * * * *